US006462268B1

(12) United States Patent
Hazy et al.

(10) Patent No.: US 6,462,268 B1
(45) **Date of Patent: *Oct. 8, 2002**

(54) CABLE WITH TWISTING FILLER AND SHARED SHEATH

(75) Inventors: Lewis E. Hazy; Janet M. Rosenbaum, both of Sidney, NE (US); Timothy N. Berelsman, Delphos, OH (US); Dennis D. Cheatham, Garland, TX (US); Jeff Stutzman; Brian Pile, both of Sidney, NE (US)

(73) Assignee: Krone, Inc., Englewood, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/835,708

(22) Filed: Apr. 16, 2001

Related U.S. Application Data

(63) Continuation-in-part of application No. 09/370,631, filed on Aug. 6, 1999, now Pat. No. 6,259,031.
(60) Provisional application No. 60/095,818, filed on Aug. 6, 1998.

(51) Int. Cl.[7] ..... H01B 11/02
(52) U.S. Cl. ..... 174/36; 174/113 R
(58) Field of Search ..... 174/113 R, 36, 174/116, 27, 113 C

(56) References Cited

U.S. PATENT DOCUMENTS

| | | | | |
|---|---|---|---|---|
| 2,584,027 A | | 1/1952 | Kendrick | |
| 3,576,939 A | | 5/1971 | Ziemek | |
| 3,843,829 A | | 10/1974 | Bridges et al. | |
| 4,150,249 A | | 4/1979 | Pedersen | |
| 4,510,346 A | | 4/1985 | Bursh, Jr. et al. | |
| 4,737,598 A | | 4/1988 | O'Conner | |
| 4,746,767 A | | 5/1988 | Gruhn | |
| 5,008,490 A | | 4/1991 | Strauss et al. | |
| 5,110,999 A | | 5/1992 | Barbera | |
| 5,216,202 A | | 6/1993 | Yoshida et al. | |
| 5,473,117 A | | 12/1995 | Morgan et al. | |
| 5,530,203 A | | 6/1996 | Adams et al. | |
| 5,532,429 A | | 7/1996 | Dickerson et al. | |
| 5,595,801 A | | 1/1997 | Fahy et al. | |
| 5,767,442 A | | 6/1998 | Eisenberg et al. | |
| 5,789,711 A | | 8/1998 | Gaeris et al. | |
| 5,834,699 A | | 11/1998 | Buck et al. | |
| 5,883,334 A | | 3/1999 | Newmoyer et al. | |
| 5,952,615 A | | 9/1999 | Prudhon | |
| 5,956,445 A | | 9/1999 | Deitz, Sr. et al. | |
| 6,010,788 A | * | 1/2000 | Kebabjian et al. | 174/102 R |
| 6,066,800 A | | 5/2000 | Renaud | |
| 6,259,031 B1 | * | 7/2001 | Totland et al. | 174/110 R |

* cited by examiner

*Primary Examiner*—Chau N. Nguyen
(74) *Attorney, Agent, or Firm*—Rader, Fishman & Grauer PLLC

(57) ABSTRACT

A cable includes a pre-selected number of binder units. Each binder unit includes an even number of paired couples of conductors, evenly divided into quads, and an additional twisted pair of conductors, coupled with and encircled around a length of a filler material, extended in parallel so the quads of conductor pairs surround the additional pair of conductors and the filler material. A binder unit wrap encloses each binder unit and a foil free edge tape is applied with the foil facing inwardly and a drain wire pulled between the foil and the unit wrap. An overall core wrap encloses each binder unit, and a shield is applied over the top of the overall core wrap such that the shield surface faces inwardly for improved termination methods. An overall drain wire is placed between the overall core wrap and overall shield. The entire cable may be enclosed by a jacket or sheath. A method for forming the cable is also disclosed.

20 Claims, 9 Drawing Sheets

CABLE WITH TWISTING FILLER AND SHARED SHEATH

RELATED APPLICATIONS

This invention is a Continuation-In-Part of U.S. Pat. No. 6,259,031, issued Jul. 10, 2001, which in turn claims priority of U.S. provisional patent application Ser. No. 60/095,818, filed on Aug. 6, 1998, and U.S patent application Ser. No. 09/386,878, filed on Aug. 31, 1999. The contents of each of these applications are hereby incorporated by reference in their entirety.

BACKGROUND OF THE INVENTION

1. Field of the Invention

The present invention relates to a cable made of twisted wire pairs, and more particularly, to a cable made of twisted wire pairs that is suitable for use in high-speed data communication applications.

2. Description of the Related Art

In general, wire pairs are twisted to minimize the interference of signals from one pair to another caused by radiation or capacitive coupling between the pairs. When a signal is present on a twisted pair, a state known as "active, " the twisted pair naturally creates an electromagnetic field around it. The electromagnetic field thus generated may induce a signal in other twisted pairs located within the electromagnetic field. Additionally, a field generated by one active twisted pair can interfere with the operation of other active pairs located in close proximity to the first pair. As a result, signals transmitted in one pair may generate "noise" within adjoining pairs, thereby degrading or attenuating the signal in the adjoining pairs. This coupling, known as "crosstalk," worsens as data transmission frequencies and data transmission length increase.

Various telecommunication systems require communication cables comprising an odd number of conductor pairs. A commonly used cable for such purposes is the twenty-five pair, category five cable. This cable, like other cables, must comply with associated TIA/EIA requirements. Various cable construction techniques have been tried by cable manufacturers in an attempt to pass the power sum near-end crosstalk (NEXT) specification for TTA/EIA twenty-five pair category five cables.

For a plenum product, the use of a filler having a star configuration would not allow the product to pass the UL 910 burn test. This is so because the star filler greatly increases the percentage of combustible plastics when compared to a copper heat sink based upon presently known state of the art materials.

The layout of the pairs of conductors comprising a cable is critical in the cable passing the TIA/EIA power sum NEXT electrical specification. One of the more successful attempts utilized a cable construction having the twenty-fifth pair jacketed and used as a center filler with six quads using two or more different pair lay schemes and one or more different quad lay lengths (L) surrounding the filler. However, the location of the twenty-fifth pair inside the filler causes increased installation times and potential for damage. For example, in cables utilizing such a cable layout, the twenty-fifth pair is prone to damage when stripping off the end of the rather thick filler jacket during installation.

Several different cable constructions have been attempted in the past, including having the twenty-fifth pair pulled straight in between two of the quads, having the twenty-fifth pair placed by the center along with the tube filler, and laying the twenty-fifth pair on the outside of the cable core. However, the cables fail to meet the TIA/EIA power sum NEXT requirements for the twenty-fifth pair. In addition, the cables also failed signal reflection loss (SRL), impedance, and attenuation requirements due to instability in the twenty-fifth pair.

It was also found that the twenty-fifth pair interfered with the pairs in the quads closest to it. The damage to the insulation of the twenty-fifth pair was caused by the twenty-fifth pair being pinched between quads, or being pinched between the quads and the filler, or being pinched between the core and the jacket.

A cable construction involving jacketing twelve and thirteen pairs of conductors together to yield a twenty-five pair cable has also been attempted with limited success. For example, the resulting shape of the cable is not round, thus making it harder to install, specifically with regard to conduit fill.

Twisted pair telecommunication wires are bundled together in large cables. Typically, 50 or more pairs of wire are included in a typical cable configuration near its termination point. However, cables coming out of a central telecommunications location may have hundreds or even thousands of pairs bundled together. In operation, each twisted pair within the cable is utilized for transmitting data as well as for furnishing direct current (DC) power to remote equipment. With signal multiplexing, a single twisted pair may service multiple data signals and multiple end users, reducing the number of individual pairs required for a desired level of service and reducing the distance between an access point and a final subscriber.

Recently, demands upon telecommunication systems have greatly increased. With the explosive growth of the Internet, consumers and telecommunication companies alike are seeking new methods for high speed data transmission. In particular, telecommunication companies and other entities are developing methods for supporting digital communication circuits at increased speed and/or distances than have existed in the past. For example, new methods for supporting digital communication circuits at increased speed and/or distance include, but are not limited to, DS1/1C/2, ADSL, SDSL, HDSL, and VDSL (where DSL stands for Digital Subscriber Loop with A=Asynchronous, S=Symmetrical, H=High Speed, and V=Very High Speed). In addition, telecommunication companies and other entities are developing these new methods for use over the existing telephone wiring infrastructure, which is generally composed of twisted pair wires bundled as cables strung over relatively long distances.

With the emerging deployment of the various high-speed digital transport systems and services, the shortcomings of the existing and deployed twisted pair communications cables are quickly becoming apparent. Emerging methods of supporting digital communication circuits, described above, rely upon using increased data transmission frequencies over long distances. For example, normal voice transmissions transmitted over telephone wires occur in a frequency range from greater than 0 to 4 kHz, while DSL applications typically transmit in a frequency range from greater than 0 to about 100 kHz over distances between 12,000 and 18,000 feet. As can be appreciated, emerging digital communications methods are highly prone to error due to crosstalk between pairs within the cable, between adjoining cables, and from outside interference, especially at the point where the incoming signal is interfaced to transport equipment such as a modem.

Typically, existing twisted pair cables attempt to isolate outside interference and crosstalk by using a common shield within the cable and by grounding the shield at a termination point. Alternatively, if multiple shields are used, existing cables fail to isolate various shields within a cable, such that the multiple shields within a cable electrically communicate with each other, especially after prolonged use. Specifically, if a telecommunications cable includes an overall shield surrounding a unit shield, the overall shield may electrically communicate with the unit shield, or else electrical interaction may occur due to shield shorts for pinholes in any insulation. Moreover, typical telecommunications cables currently in use terminate the overall shield by drawing out a drain wire and simply clamping it to ground. Unfortunately, grounding the drain wire usually causes it to act as an antenna that draws interference into the cable from outside sources.

SUMMARY OF THE INVENTION

The present invention is directed to a cable for supporting digital communication circuits and increased speed and/or distances. The cable is constructed from multiple shielded or foil screened binder units where each binder unit includes an even number of twisted wire pairs, along with an additional twisted wire pairs paired with, and encircles a filler material along its length. Thus, the total number of paired conductors is an odd number. The even number of twisted wire pairs is evenly divided into quads or sub-units with each quad having at least four twisted wire pairs. A shield or foil screen encloses the quads of twisted wire pairs, the additional twisted wire pair and the filler material to form a screened binder unit having a pre-selected number of twisted wire pairs. Preferably, each screened binder unit has twenty-five or less twisted wire pairs. An overall core wrap encloses a pre-selected number of screened binder units, and a unit shield is applied over the top of the overall core wrap. A drain wire may be pulled between the unit shield and the core wrap of one or more screened binder units. The shield surface faces inwardly for improved termination to ground. Finally, the entire cable may be enclosed by a jacket or sheath.

In one embodiment of the invention, the filler material has a larger diameter than the additional twisted wire pair, and the filler material is twined with the additional twisted wire pair, so that the filler material causes an air gap to surround any portion of the additional twisted wire pair that is not in contact with the filler material. In another embodiment of the invention, the filler material secures the additional twisted wire pair within a longitudinal groove formed in the filler material.

In a preferred embodiment of the invention, the filler material has a dielectric constant higher than a dielectric constant of air. More particularly, the filler material is selected from at least one of the following: polyfluoroalkoxy,TFE/Perfluoromethyl-vinylether, ethylene chlorotrifluoroethylene, polyvinyl chloride, fluorinated perfluoroethylene polypropylene and flame retardant polypropylene.

Also in a preferred embodiment of the invention, the jacket material includes a dielectric layer. The dielectric layer can be a single or a multiple dielectric layer, with each layer comprising at least one of the following: low smoke zero halogen, polyvinyl chloride, flame retardant polyethylene, linear low density polyethylene, polyvinylidene fluoride, ethylene chlorotrifluoroethylene, fluorinated ethylene propylene, thermoplastic elastomer, and polyurethane.

Each conductor can be a bare copper wire, and each should be insulated with an insulating material having a dielectric constant no greater than about 2.5. Normally, each bare copper wire is between 22 AWG and 24 AWG. The insulating material preferably includes at least one of the following: flame retardant polyethylene, flame retardant polypropylene, high density polyethylene, polypropylene, polyfluoroalkoxy, solid or foamed TFE/perfluoromethylvinylether, solid or foamed fluorinated ethylene-propylene, and foamed ethylene chlorotrifluoroethylene.

In the cable of the present invention, the overall shield is isolated from the unit shields, and each shield may be terminated to ground independently of the other. In this way, the inner binder units are isolated from outside interference, e.g., from other adjacent cables. The shields are also isolated from contacting each other or from contacting individual wires or wire pairs, by the overall core wrap, thereby preventing shorts or signal loss through pinholes in the twisted pair insulation.

Moreover, both the overall shield and the unit shield are applied with the foil side inwardly oriented. This arrangement allows the foil to be folded back over the cable and the binder unit, respectively, and terminated using a simple grounding clamp, rather than by grounding the drain wire as is currently the practice. By clamping the shields instead of the drain wire, shielding performance is enhanced because the drain wires are not able to act as an antenna and draw interference into the cable.

By separating the twisted pair wires into manageably sized binder units, convenience and efficiency of use is enhanced. For example, separate digital services may be provided through each of the binder units based upon the frequency spectrum within which they operate. Alternatively, one binder unit may be used as a "send" unit, while an adjacent binder unit may be designated the "receive" units. By separating "send" and "receive" functions between binder units, rather than simply between twisted pairs within a single unit, local crosstalk is minimized, leading to increased transmission distances.

The present invention is also directed to a method for manufacturing the above-described cable. First, the pair of conductors is paired with each other to make an even number of twisted wire pairs. Then, the additional pair of conductors is paired, making the total number of twisted wire pairs an odd number. The even number of twisted wire pairs are then evenly divided into quads or sub-units of at least two twisted wire pairs. The additional twisted wire pair is coupled with and encircles around the filler material along its length. Then, the quads of twisted wire pairs and the additional twisted wire pair coupled with the filler material are extended in parallel to form a cable so the quads of conductor pairs surround the additional twisted wire pair and the filler material. Then, the quads of twisted wire pairs and the additional twisted wire pair coupled with the filler material, usually twenty-five or less pairs of conductors, are enclosed by a shield or foil screen to form a screened binder unit. Next, the screened binder units are stranded to form the cable. Finally, a jacket material surrounds the cable.

DESCRIPTION OF THE PREFERRED EMBODIMENTS

Figure 1:
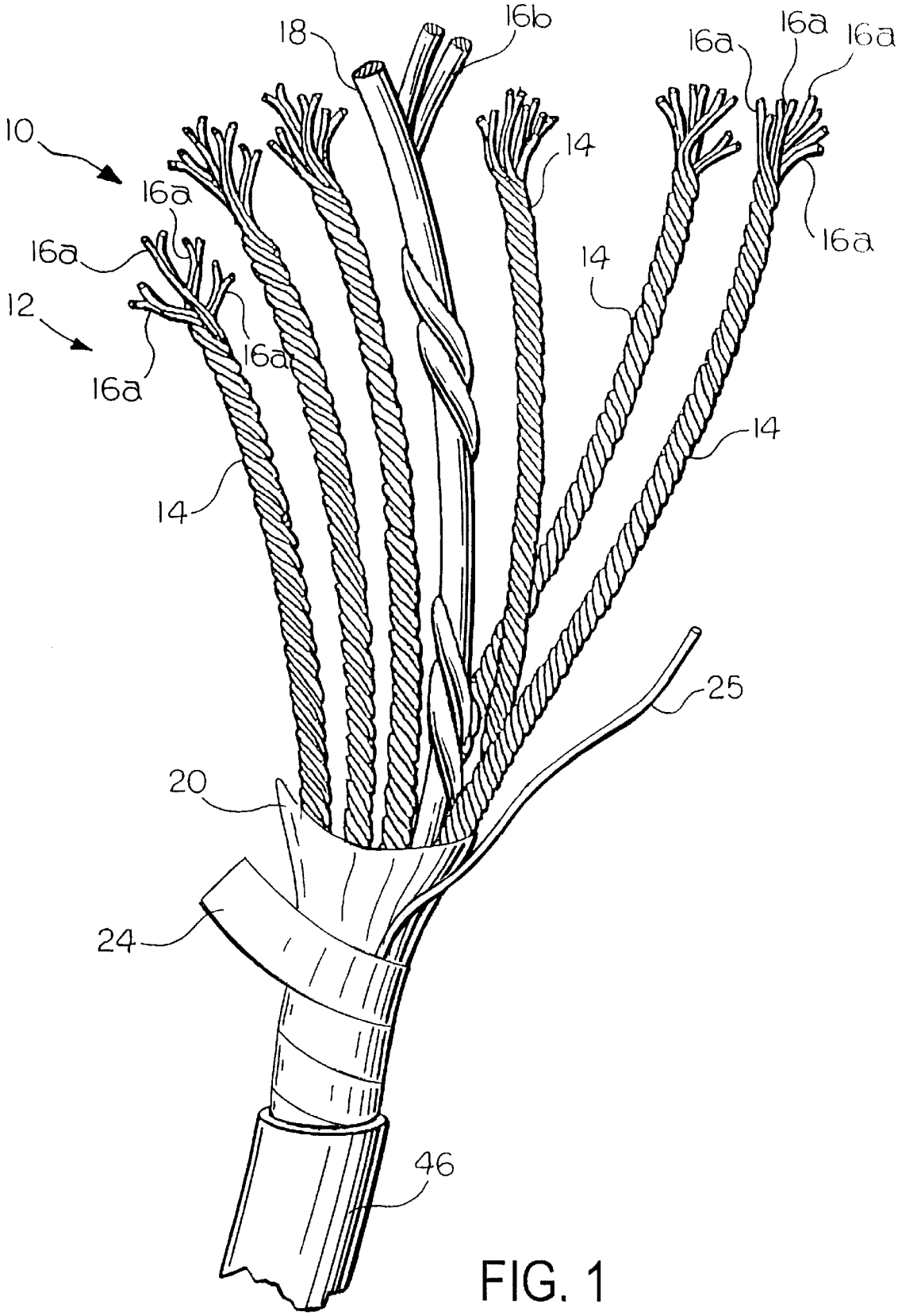
FIG. 1 shows a perspective view of a cable according to a first embodiment of the invention, where the odd pair of conductors is wrapped around a filler material of low flexibility.

With reference to FIG. 1, a transport cable, shown generally at 10, according to a first embodiment of the invention is disclosed. The cable 10 includes a pre-selected number of binder units 12. According to one embodiment of the invention, a single binder unit 12 includes one or more groups or quads 14, each quad 14 comprising at least two wire pairs 16*a*, and an additional wire pair 16*b* wrapped around a filler 18. Preferably, the binder unit 12 comprises six quads 14, each quad 14 having four wire pairs 16*a* for a total of twenty-four wire pairs 16*a*, and the additional twenty-fifth wire pair 16*b* wrapped around the filler 18. However, it will be appreciated that the number of twisted wire pairs 16*a*, 16*b* is predetermined by the manufacturer of the binder unit 12, but in practice it has been found that twenty-five twisted wire pairs 16*a*, 16*b* and the filler 18 may easily be combined into a single binder unit 12.

Figure 3:
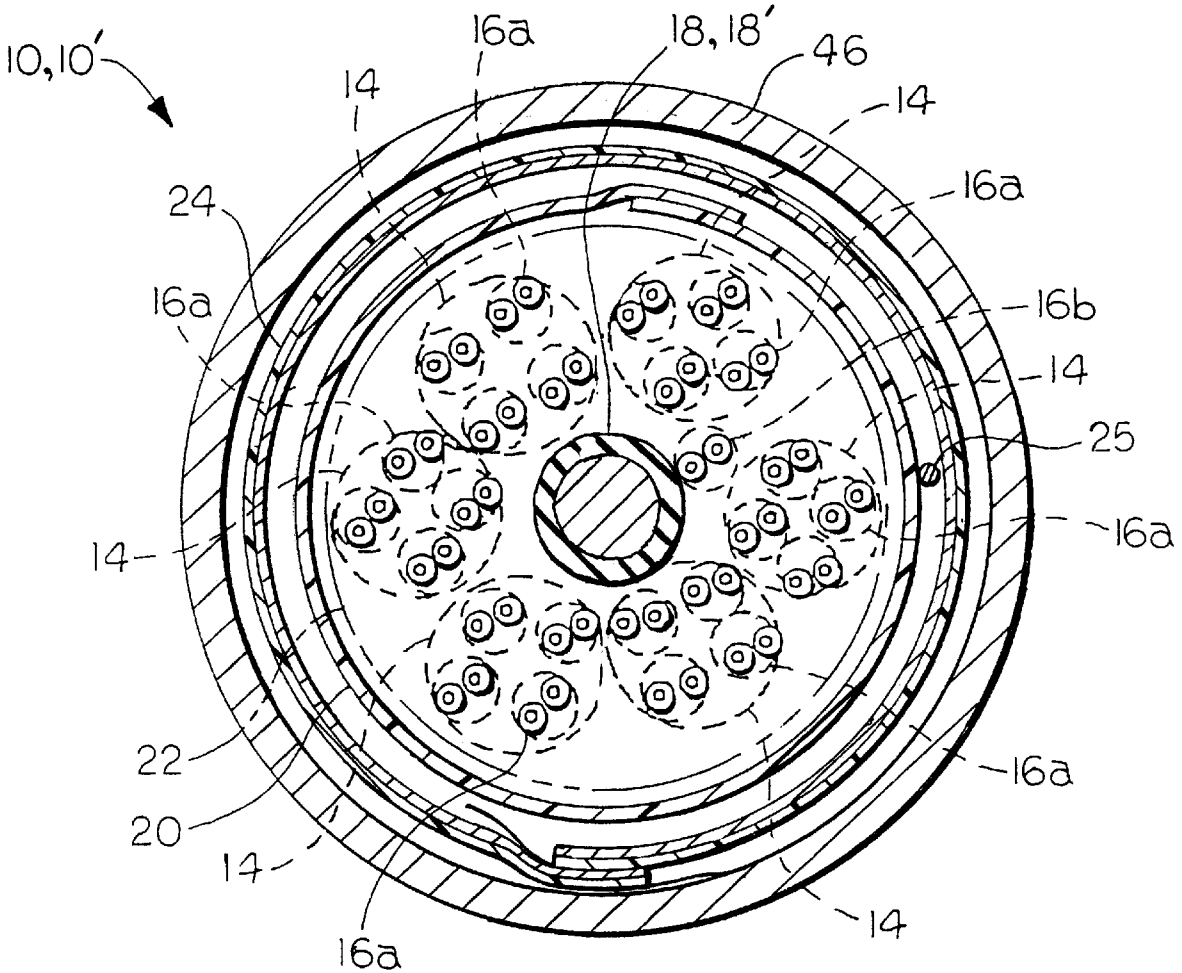
FIG. 3 shows a cross sectional view of a cable according to the first or second embodiment of the invention.
Figure 5:
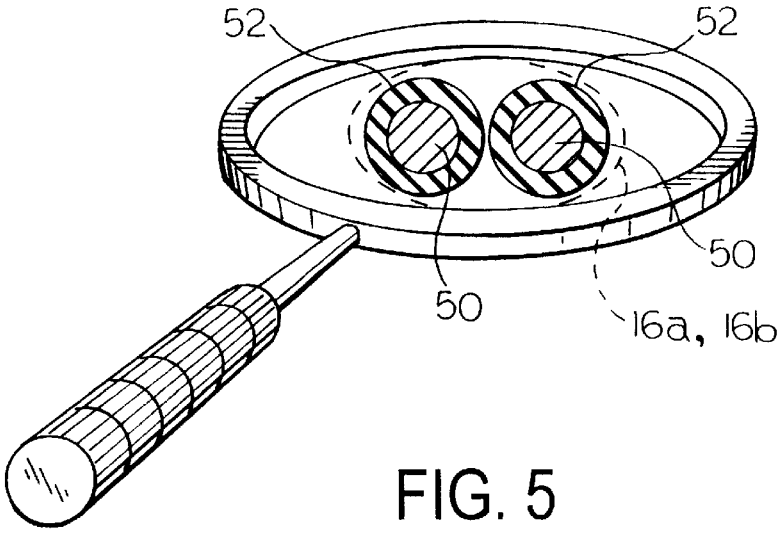
FIG. 5 is an enlarged cross sectional view of a pair of conductors according to the invention.

Referring now to FIG. 5, each twisted wire pair 16*a*, 16*b* comprises bare copper conductors 50 between #22 AWG and #24 AWG. Each conductor 50 is insulated with a material 52 having a dielectric constant of about 2.5 or less, including flame retardant polyethylene (FRPE), flame retardant polypropylene (FRPP), high density polyethylene (HDPE), polypropylene (PP), MFA, PFA or FEP in solid or foamed form, and foamed ECTFE. The conductors 50 are twined to form the twisted wire pairs 16*a*, 16*b* as shown in FIG. 5, and then assembled as shown in FIG. 3. The dotted lines in FIG. 3 are used to show groupings of wire pairs 16*a*, 16*b*, and quads 14 that consist of braided conductor pairs 16*a*, 16*b*, but do not designate a material. However, it will be appreciated that a material can surround each of the quads 14. As an example, a group shield made of an aluminum/polyester material, an aluminum/polypropylene material, and/or a tinned or aluminum braid may surround each quad 14.

Another aspect of the invention is that the additional wire pair 16*b* in each binder unit 12 is wrapped around the filler 18 in a manufacturing step while, or before cabling the filler 18 and the twenty-fifth wire pair 16*b* with the other six quads 14. The filler 18 is made of a high flame retardant material with a dielectric constant lower than 3.2 to avoid signal reflection loss (SRL) failures due to signal reflections between layers of unlike dielectric constants. Care is taken in choosing the material of the filler 18 such that the electromagnetic fields propagating down the wire are attenuated to the slightest degree possible, and at the same time pair to pair coupling fields are attenuated to the highest degree possible. Acceptable materials include, for example, polyfluoroalkoxy (PFA), TFE/Perfluoromethylvinylether (MFA), ethylene chlorotrifluoroethylene (ECTFE), polyvinyl chloride (PVC), fluorinated perfluoroethylene polypropylene (FEP) and flame retardant polypropylene (FRPP). In addition, each of the quads 14 demonstrates a worst pair near end crosstalk within the group of 35 db at 100 mHz for data transmission, in accordance with TIA/EIA minimum requirements. Furthermore, a near end crosstalk isolation between the quads 14 demonstrates a worst case performance of 38 db power sum at 100 mHz in accordance with TIA/EIA minimum requirements.

Figure 2:
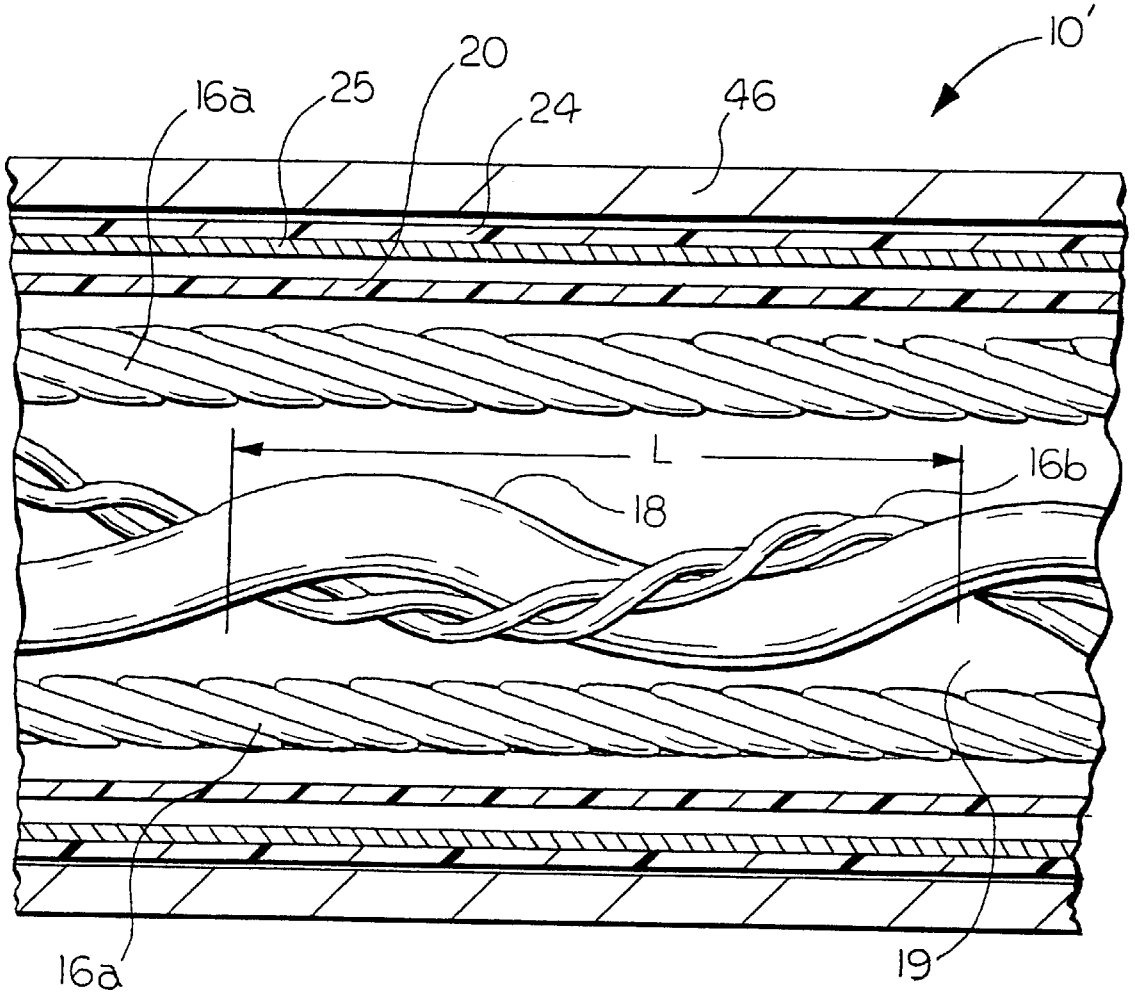
FIG. 2 shows a longitudinal cutaway view of a cable according to a second embodiment of the invention, where the odd pair of conductors is twined with a flexible filler material.

In a second embodiment of the invention, a cable 10' includes a filler 18' that is flexible enough to twine with the twenty-fifth wire pair 16*b* as shown in FIG. 2, rather than having the twenty-fifth wire pair 16*b* wrap around the filler 18 as shown in the first embodiment of FIG. 1. When the twenty-fifth wire pair 16*b* is twisted with filler 18', the filler 18' exhibits a varying central axis resulting in a wavy shape. The wavy shape protects the twenty-fifth wire pair 16*b* from being pinched between the surrounding quads 14 and filler 18', as shown in FIGS. 2 and 3. This is especially true when the filler 18' has a diameter greater than the width of the twenty-fifth wire pair 16*b*.

Furthermore, as shown in FIG. 2, the varying central axis provides an air pocket 19 along the center of the cable core. The air pocket 19 enhances the dielectric constant surrounding the twenty-fifth wire pair 16*b*, and maximizes separation and provides a dielectrically enhanced border to the six other quads 14 in the construction.

One of the important effects of twining the twenty-fifth wire pair 16*b* with the filler 18, 18' prior to or while cabling it with the six other quads 14 is that the position of the twenty-fifth wire pair 16*b* is altered compared to the other six quads 14 such that the twenty-fifth wire pair 16*b* will only be close to one quad 140 once every repetition of the lay length (L) of the twenty-fifth wire pair 16*b* twined with the filler 18, 18'. The electromagnetic coupling between pairs 10 is evenly distributed with reference to the twenty-fifth wire pair 16*b* in the above-described construction. As a result, the cross-talk is minimized in the resulting cable.

Furthermore, twining the twenty-fifth wire pair 16*b* with the centrally located filler 18, 18', with the quads 14 surrounding the filler 18, 18' and the twenty-fifth pair 16*b*, ensures that the cable construction stays the same during installation, resulting in a substantially round cable. This is especially important during cable installation. When installing the cable in conduits, cable trays and over J hooks, for example, the cable is forced around corners and is subject to various strains. The round shape of the cable makes it easier to install, and twisting the twenty-fifth wire pair 16*b* with the filler 18, 18' ensures that it stays in place even when the cable 10, 10' is forced around bends during installation.

Having the first twenty-four pairs cabled into four pair quads 14 in a manufacturing step prior to or while cabling all six of the quads 14 and the filler 18, 18' with the twenty-fifth wire pair 16*b* into the cable core causes the positions of the individual pairs 10 in the quads 14 in reference to the outside of the core to be altered at the frequency of the quad lay lengths (L). Such a construction minimizes capacitive coupling between pairs in a first cable with pairs having the same lay lengths (L) in adjacent cables installed next to the first cable or around it in, for example, a cable tray. In turn, crosstalk between adjacent installed cables is minimized.

Figure 4:
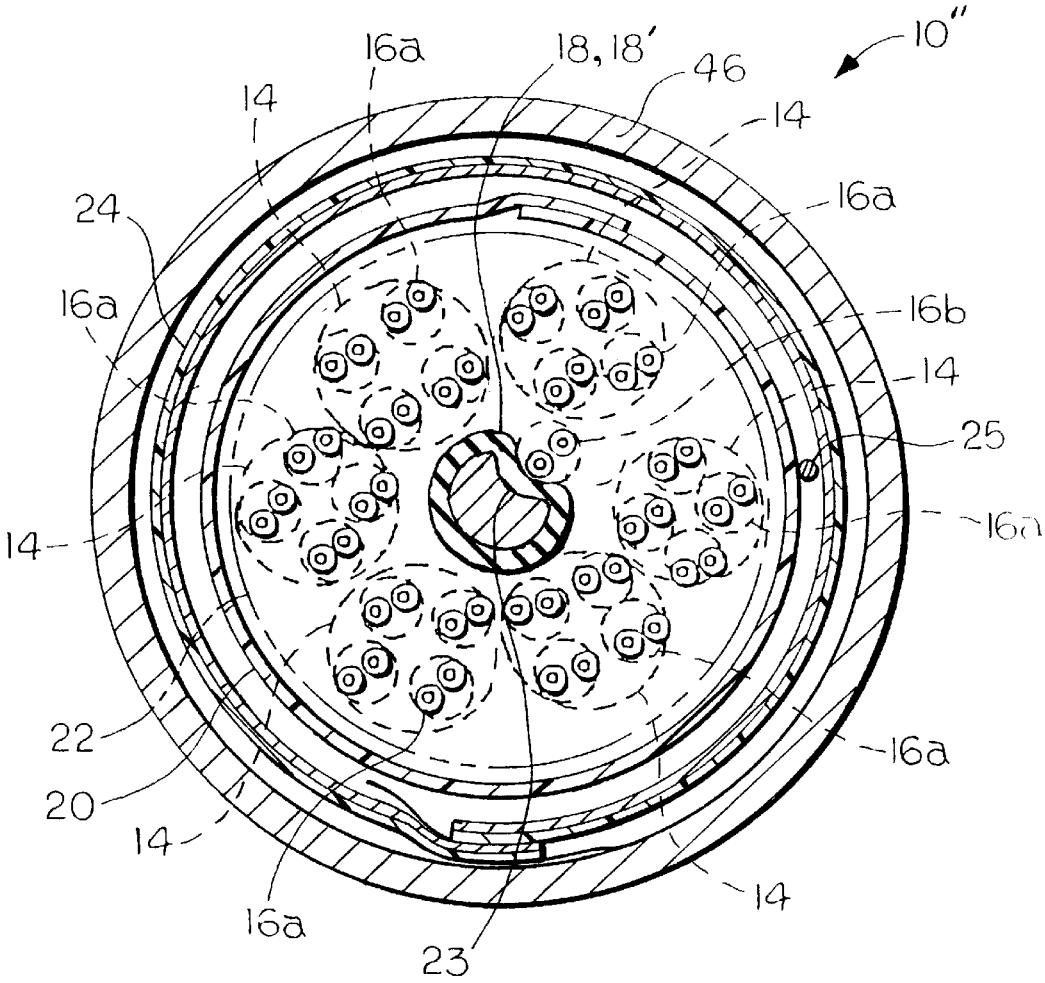
FIG. 4 shows a cross sectional view of a cable according to a third embodiment of the invention where the filler material includes a longitudinal groove.

FIG. 4 shows the cross-sectional view of cable 10', made according a third embodiment of the invention. In the third embodiment of the cable 10', the physical protection and dielectric effect of the twenty-fifth wire pair 16*b* are further enhanced by making a filler 18' with a longitudinal groove 23, deep and wide enough to let the twenty-fifth wire pair 16*b* ride in it.

Although the above-described construction of the cable 10' compromises to some extent the resulting cable's attenuation performance, it also enhances the cable's NEXT performance. Cable 10' (shown in FIG. 4) displays an increase in attenuation in comparison to the attenuation of cable 10' (shown in FIG. 3) because in the construction of cable 10', the twenty-fifth wire pair 16*b* is partially encompassed by the material comprising filler 18'. The material of filler 18' has a much higher dielectric constant than air (which primarily surrounds twenty-fifth wire pair 16*b* of cable 10'). As a result, the attenuation loss is higher in cable 10'. Accordingly, because cable 10" is partially encompassed by the material comprising filler 18", it has minimal crosstalk in comparison with cable 10'.

Referring now to FIGS. 1–4, the twisted wire pairs 16*a*, 16*b* and filler 18, 18', 18" of each binder unit 12 are bundled together and wrapped with a standard unit wrap 20 to form a bound core 22. The unit wrap 20 may comprise a polyester film, or other material known in the art. Preferably, the unit wrap 20 comprises a two-mil thick polyester film of the type well known in the art. In addition, a foil free edge tape 24 is placed around the unit wrap 20 to form a unit shield 24. The foil free edge tape 24 may be manufactured to include, alone or in combination with other materials, an aluminum/polyester material, an aluminum/polypropylene material, and/or a tinned or aluminum braid.

Figure 7:
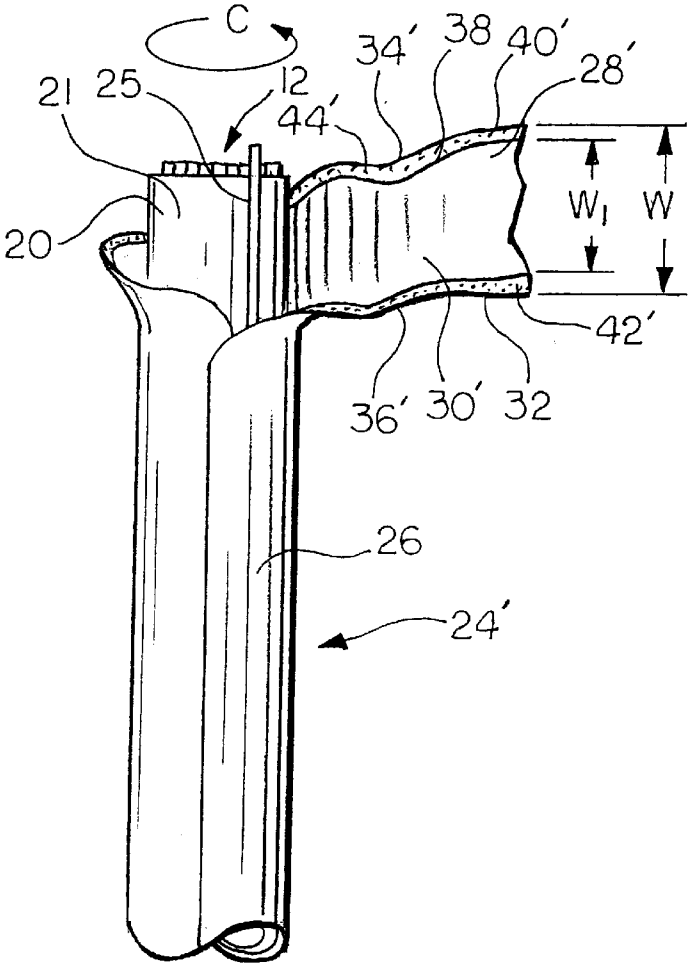
FIG. 7 shows a perspective view of an alternative screen tape configuration according to the invention.
Figure 6:
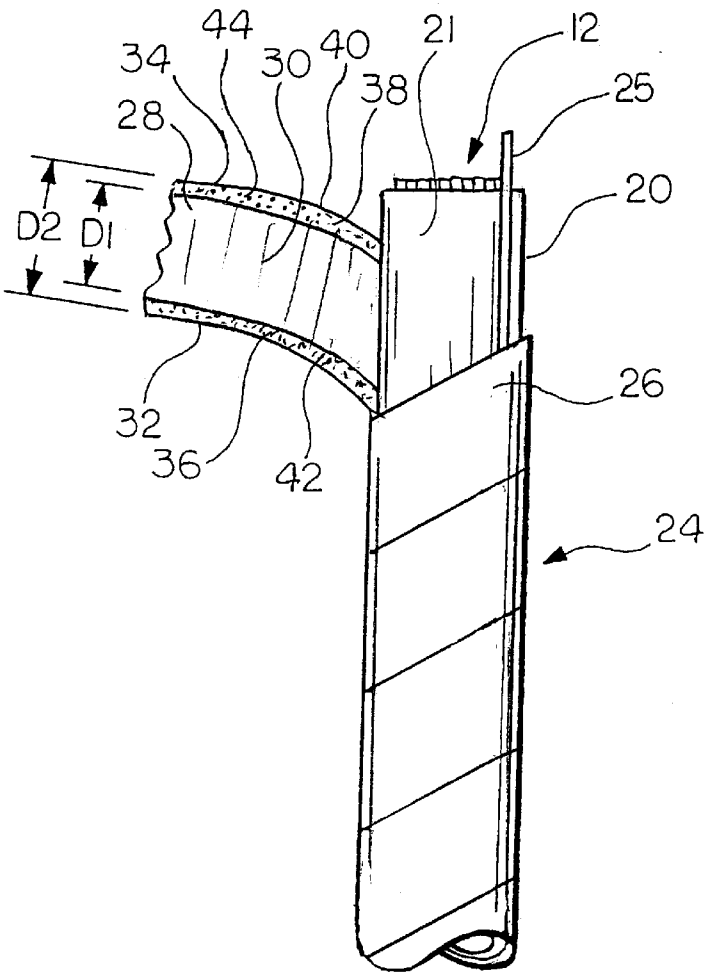
FIG. 6 shows a perspective view of an aluminum/polyester screen tape configuration according to the invention.

As shown in FIGS. 6 and 7, the foil free edge tape or unit shield 24 includes an outer surface 26 and an inner surface 28. The outer surface 26 of the tape 24 is an exposed non-conductive material such as an appropriate polymer or plasticized material of the type well-known in the art. An inner surface 28 of the tape 24 includes a conductive foil surface 30. The foil surface 30 extends the full longitudinal length of the tape 24 and is of a predetermined thickness, but preferably extends less than the full width of the tape 24, making the longitudinal edges of the tape "foil free." In one embodiment, a portion of the non-conductive material remains exposed on the inner surface 28 of the tape 24 adjacent the foil surface 30. Preferably, the exposed non-conductive material is coated with an adhesive of the type known in the art.

As best seen in FIG. 6, the foil surface 30 of the inner surface 28 of the tape 24 is most preferably centered between the longitudinal sides 32, 34 of the tape 24 such that exposed portions 40, 42 remain between the longitudinal sides 32, 34 of the tape 24 and the respective longitudinal sides 36, 38 of the foil surface 30. Distances D1 and D2 define the extent of the foil free edge of the tape 24. In the most preferred embodiment, the distances D1 and D2, measured between respective tape longitudinal sides 32, 34 and foil surface longitudinal sides 36, 38, are identical, but they need not be. As in a previous embodiment, the exposed portions 40, 42 are coated with an adhesive 44 capable of forming a bond between a respective exposed portion 40, 42 and the outer surface 26 of the tape 24.

When the foil free edge tape 24 is helically wound about the unit wrap 20 and a unit drain wire 56, the helical spacing of the foil free edge tape 24 is such that the first longitudinal side 36 of the foil surface 30 is wound substantially adjacent the second longitudinal side 38 of the foil surface 30 on successive winds, as shown in FIG. 6. The foil surface may even overlap slightly about the circumference of the unit wrap 20. However, the leading edge exposed tape portion 40, including the adhesive 44, contacts the exterior surface 21 of the unit wrap 20, while the trailing edge exposed tape portion 42, including the adhesive 44, contacts the outer surface 26 of the tape 24 of the preceding wind. In this way, the tape 24 is secured both to the unit wrap 20 and to adjacent winds of the tape 24, thereby preventing migration of the tape 24 or gaps between successive winds when the binder unit 12 is flexed or moved. Moreover, because the tape portions 40, 42 do not include foil, no part of the foil surface 30 is exposed on the outer surface 26 of the tape 24.

In another embodiment, shown in FIG. 7, the tape 24' may be formed of a single long strip of polymeric material having a width W that is slightly larger than the circumference C of the exterior surface 21 of the unit wrap 20. The foil surface 30' of the tape 24' has a width W1 that is substantially equal to the circumference C of the exterior surface 21 of the unit wrap 20 while accommodating the insertion of the unit drain wire 56. The remaining width (W–W1) of the inner surface 28' of the tape 24' defines an exposed portion 40' that includes an adhesive 44'. Instead of being helically wound about the exterior of the unit wrap 20 and the unit drain wire 56, the width W of tape 24' is wrapped circumferentially about the binder unit 12 and the unit drain wire 56 such that first and second longitudinal surfaces 32', 34' meet along the axial length of the binder unit 12. In this embodiment, if the tape 24' is wrapped circumferentially about the binder unit 12, then the unit wrap 20' is comprised of an elongated strip of polyester film that is wrapped circumferentially along the longitudinal length of the twisted pairs.

The exposed portion 40', including the adhesive 44', then overlaps a portion of the tape outer surface 26', thereby sealing the unit wrap 20 within the tape 24'. As shown in FIG. 7, the inner surface 28' of the tape 24' may include opposing exposed portions 42', 44' including an adhesive so that one longitudinal edge of the tape 24' maybe affixed to the exterior surface 21 of the unit wrap 20 if desired. In this way, none of the foil surface 30' remains exposed on the exterior of the binder unit 12.

Referring now to FIGS. 1–4, an overall jacket 46 is placed around the foil free edge tape 24 of the pre-selected number of binder units 12. The overall jacket 46 comprises a single dielectric layer or multiple dielectric layer, including layers comprising any of the following materials: low smoke zero halogen (LSOH), polyvinyl chloride (PVC), flame retardant polyethylene (FRPE), linear low density polyethylene (LLDPE), polyvinylidene fluoride (PVDF), ethylene chlorotrifluoroethylene (ECTFE), fluorinated ethylene-propylene (FEP), thermoplastic elastomer (TPE) or polyurethane. There also may be an outer shield placed around all of the paired conductors that may include, alone or in combination with other materials, an aluminum/polyester material, an aluminum/polypropylene material, and/or a tinned braid or aluminum braid.

The exact combinations of materials are selected based on the environmental characteristics (indoor, outdoor, chemical plant, high humidity, temperature extremes, etc.) and overall flame retardant characteristics (nonplenum general horizontal cabling, riser, plenum, none, etc.) that a given cable is required to meet for a given installation.

Figure 8:
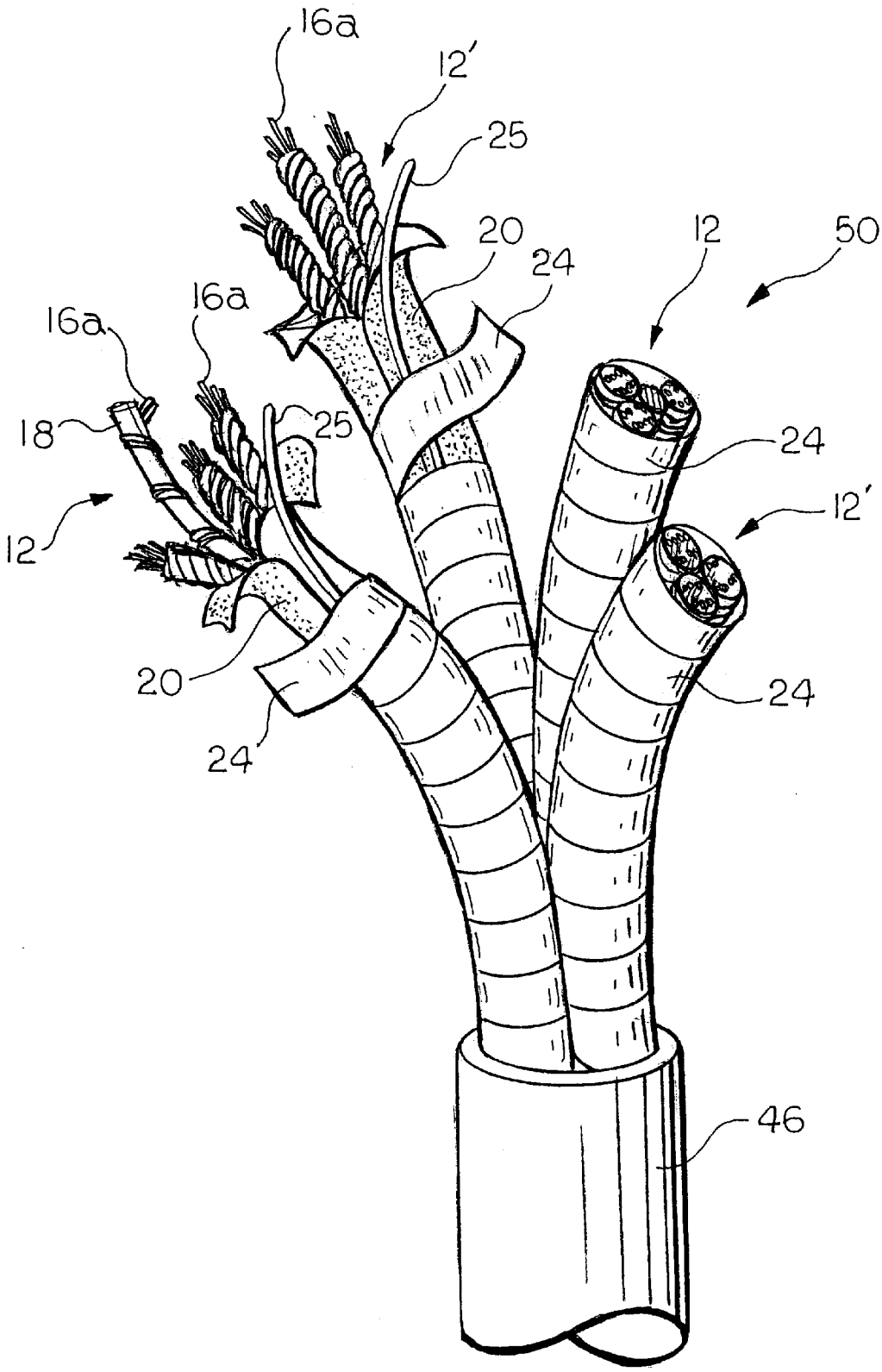
FIG. 8 shows a perspective view of a fifty pair cable according to a fifth embodiment of the invention.

For example, a fifty pair cable 50 according to another embodiment of the invention is shown in FIG. 8. Preferably, the fifty pair cable 50 includes four binder units 12, 12' within the overall jacket 46. Each binder unit 12 has three quads 14 with four twisted wire pairs 16*a* in each quad 14, the additional twisted wire pair 16*b*, and the filler 18 for a total of thirteen twisted wire pairs 16*a*, 16*b*. Each binder unit 12' has three quads 14 with four twisted wire pairs 16*a* in each quad 14 for a total of twelve twisted wire pairs 16*a* in each quad 14. Thus, the cable 50 has a total of fifty twisted wire pairs 16*a*, 16*b*. In an alternative embodiment, the fifty pair cable described above could also be constructed by having two twenty-five pair binder units, as shown in FIG. 1.

Figure 9:
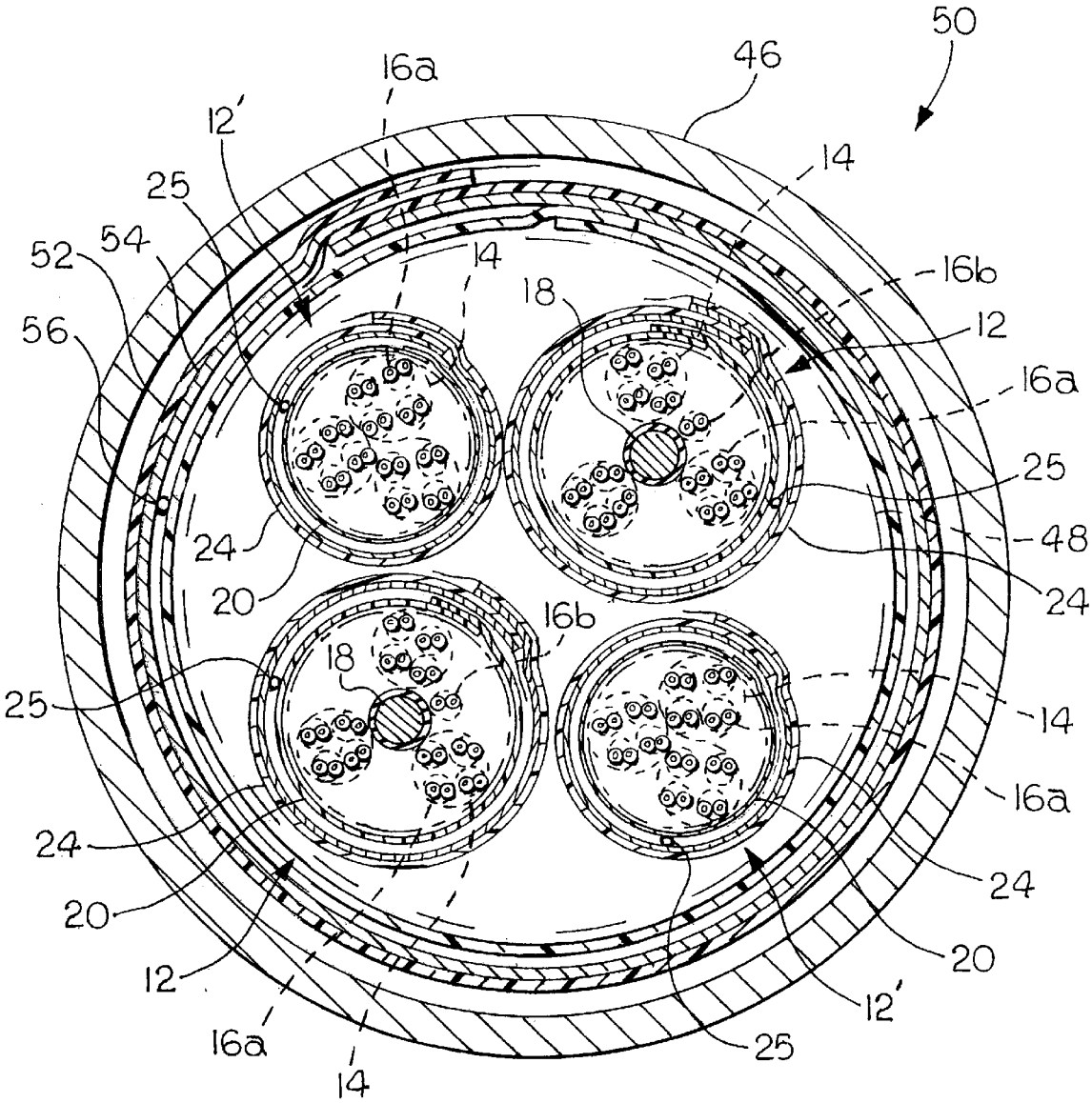
FIG. 9 shows a cross sectional view of the fifty pair cable according to the fifth embodiment of the invention.

As best seen in FIG. 9, each binder unit 12, 12' is constructed as described above, and is placed within the cable 50 having an overall shield 52 that encircles the combined bound core 48 and all of the binder units 12, 12'. To ensure that no electrical interaction occurs between the overall shield 52 and the tape 24 of each binder unit 12, 12', an outer core wrap 54 is formed about the exterior of the combined bound core 48. The outer core wrap 54 can be made of conventional materials, such as a polyester film similar to the unit wrap 20, or other materials. The cable 50 will be subject to flex over time, which may open gaps in the tape 24 of each binder unit 12, 12'. Without the outer core wrap 54, tape gaps would potentially cause contact between the overall shield 52 and the shield 22 of each binder unit 12 over time as the cable 50 is flexed. Thus, the outer core wrap 54 is an added precaution to enhance isolation of each binder unit 12, 12'.

An overall shield drain wire 56 is placed between the outer core wrap 54 and the overall shield 52. Although the illustrated embodiment shows a unit drain wire 25 for each binder unit 12, 12', it will be appreciated that the cable 50 may include only the overall shield drain wire 56, thereby eliminating the need for unit drain wire 25 for each binder unit 12, 12'. In one embodiment, the overall shield 52 is a conventionally available foil shield. In another embodiment, the overall shield 52 is a braided shield of the type conventionally known. However, in the preferred embodiment, the overall shield 52 is comprised of a combination foil and braid to provide the greatest amount of shielding. Finally, the overall jacket or sheath 46 is applied over the entire length of the cable 50.

Because the overall shield 52 is isolated from the unit shields 24, the overall shield 52 may be terminated to ground independently of the individual unit shields 24, thereby protecting the inner binder units 12 from outside interference, for example, from other adjacent cables. Moreover, the overall shield 52 is preferably applied with the foil side in facing contact with the outer surface of the outer core wrap 54. This arrangement allows the foil to be folded back over the jacket 46 and terminated using a simple grounding clamp, rather than by grounding the drain wire as is currently the practice. By clamping the overall shield 52 instead of the drain wire 56, shielding performance is enhanced because the drain wire 56 is not able to act as an antenna and draw interference into the cable. Similarly, the foil surface 30 of the foil free edge tape 24 applied to each binder unit 12 is separated from the twisted pairs 10 by the unit wrap 20. The unit wrap 20 offers the benefits of isolating the twisted pair conductors from the foil surface 30, thereby preventing shorts or signal loss through pinholes in the twisted pair insulation.

Like the overall shield 52, each binder unit shield 22 may be terminated independently to ground, thereby providing protection against binder unit to binder unit crosstalk within the cable. In fact, because of the foil free edge tape arrangement, only a minimal amount of shield 22 need be removed for termination. In practice, when an installer or end user is attaching the cable to various contact points, including to ground, the installer may optionally apply a separate appropriately sized tube of a known, shrink-wrap material, around the outside of each binder unit 12. However, a short length, on the order of two to three inches, of the binder unit is left exposed by the installer on each end of the binder unit 12. The foil free edge tape 24 is then stripped back to the edge of the tube and is terminated using a grounding clamp or by clamping a connector over the shield, as for example, a 50-pin connector ground. The shrink wrap tube prevents further unwinding of the foil free edge tape 24, and ensures that the cable of the present invention retains its intended dimensional shape. The twisted pairs within the unit may then be connected conventionally to either a termination point, such as a punch-down block, or to the 50-pin connector. In either case, only a minimal amount of each twisted pair is exposed outside of the shield. Because the twisted pairs are surrounded by the unit wrap 20, the shield 22 is isolated from the twisted pairs 10, minimizing the impedance mismatch between the minimally exposed end portions of each twisted pair 10 and the unexposed portions of the twisted pairs. Finally, application of the outermost shrink wrap tube over the shield 22 stabilizes the binder unit, preventing distortion of the binder unit 12 under flex or torsional forces.

Alternatively, the foil free edge tape 24 may face outwardly, instead of inwardly as described above. In this embodiment, a single drain wire 56 is required for the multiple binder units 12, instead of a drain wire 56 for each binder unit 12 as described above. However, the isolation between each binder unit 12 may be lost because of the increased electrical conductivity between each binder unit 12.

Using the cable 50 manufactured according to the present invention, separate digital services may be provided through each of the binder units based upon the frequency spectrum within which they operate. Alternatively, one binder unit may be used as a "send" unit, while an adjacent binder unit may be designated the "receive" units. By separating "send" and "receive" functions between binder units, rather than simply between twisted pairs within a single unit, local crosstalk is minimized, leading to increased transmission distances.

Figure 10:
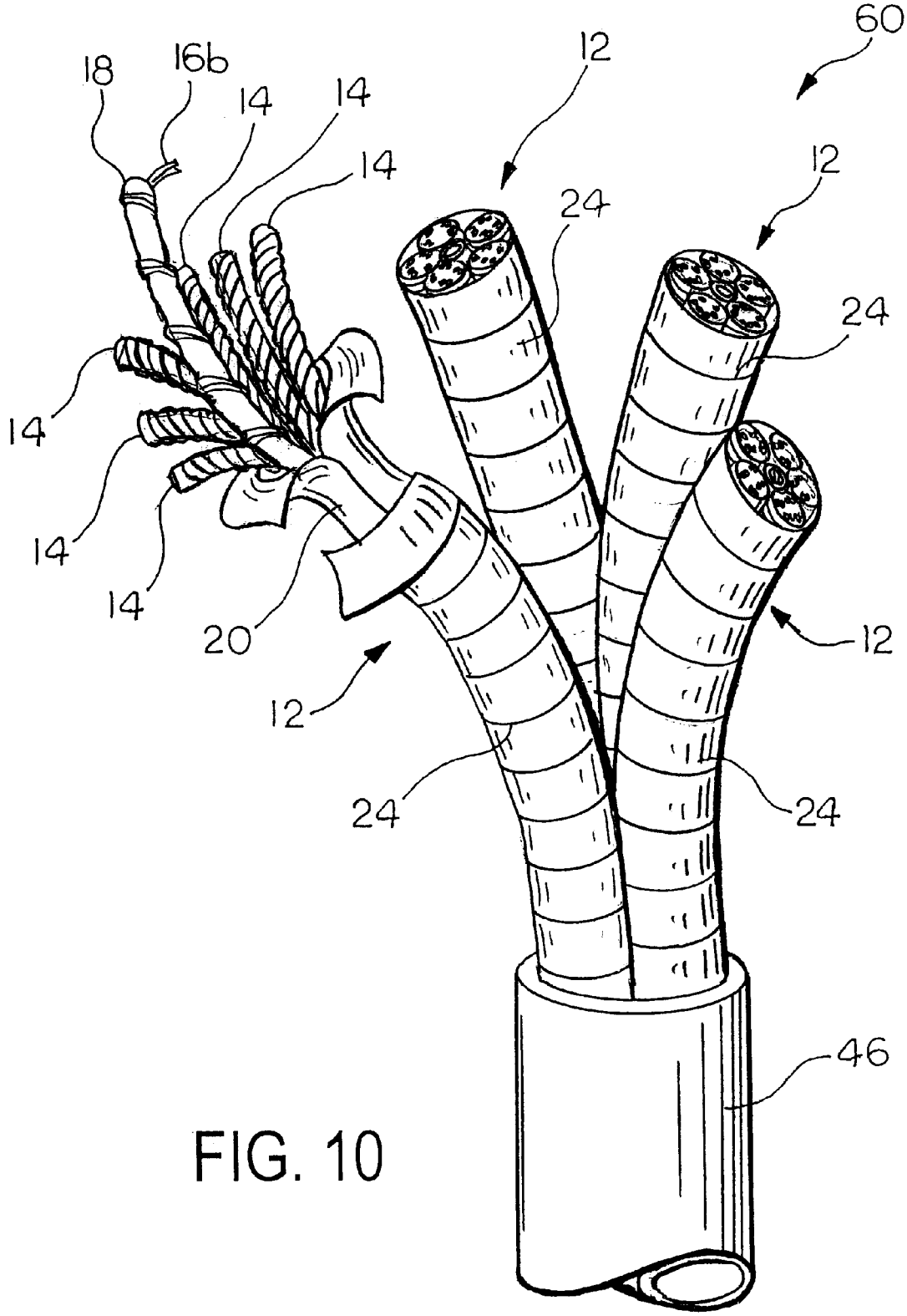
FIG. 10 shows a cross sectional view of a one hundred pair cable according to the sixth embodiment of the invention.
Figure 11:
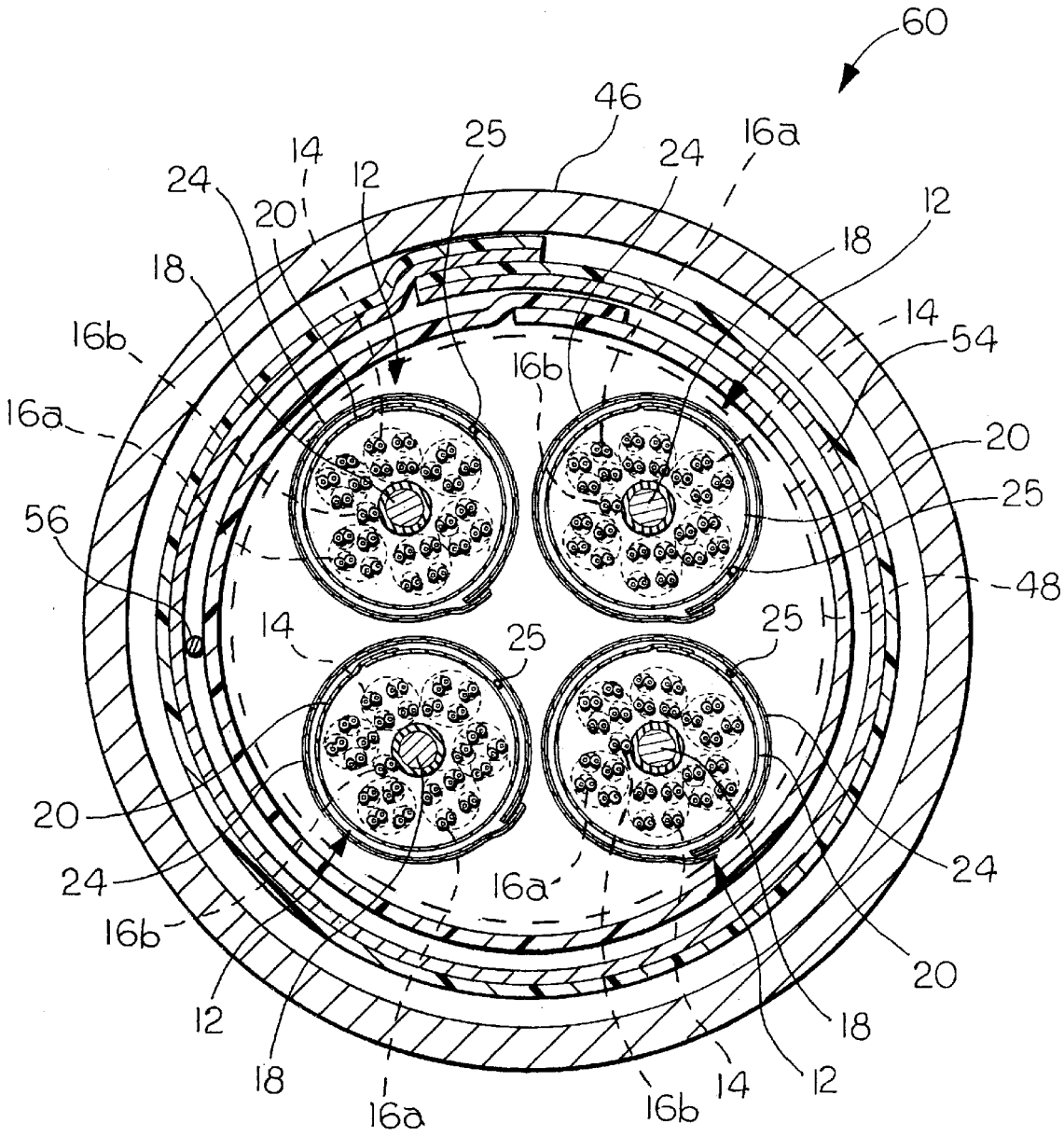
FIG. 11 shows a cross sectional view of the one hundred pair cable according to the sixth embodiment of the invention.

Referring now to FIGS. 10 and 11 a one hundred pair cable 60 according to yet another embodiment of the invention is disclosed. Preferably, the one hundred pair cable 60 includes four binder units 12, similar to the binder unit 12 shown in FIG. 1.

As best seen in FIG. 11, each binder unit 12 is constructed as described above, and is placed within the cable 60 having the overall shield 52 that encircles the combined bound core 48 and all of the binder units 12. To ensure that no electrical interaction occurs between the overall shield 52 and the shield 24 of each binder unit 12, the outer core wrap 54 is formed about the exterior of the combined bound core 48 using conventionally available methods and materials, such as a polyester film similar to the unit wrap 20, or other materials. Similar to the cables 10 and 50, the cable 60 will be subject to flex over time, which may open gaps in the tape 24 of each binder unit 12. Without the outer core wrap 54, tape gaps would potentially cause contact between the overall shield 52 and the shield 22 of each binder unit 12 over time as the cable 60 is flexed. Thus, the outer core wrap 54 is an added precaution to enhance isolation of each binder unit 12.

Similar to the cable 50, the overall shield drain wire 56 is placed between the outer core wrap 54 and the overall shield 52. Although the illustrated embodiment shows a unit drain wire 25 for each binder unit 12, it will be appreciated that the cable 60 may include only the overall shield drain wire 56, thereby eliminating the need for unit drain wire 25 for each binder unit 12. In one embodiment, the overall shield 52 is a conventionally available foil shield. In another embodiment, the overall shield 52 is a braided shield of the type conventionally known. However, in the preferred embodiment, the overall shield 52 is comprised of a combination foil and braid to provide the greatest amount of shielding. Finally, the overall jacket or sheath 46 is applied over the entire length of the cable 60.

As described above, a cable with a twisting filler and a shared sheath is formed with one or more binder units, each binder unit having at least four twisted wire pairs. In addition, one or more binder units may include an additional twisted wire pair encircling a filler. Each unit is bound by a unit wrap and an edge free foil tape. A unit drain wire may be positioned between the unit wrap and the edge free foil tape. An outer jacket or sheath encloses the one or more binder units.

Although the illustrated embodiments of the invention are described for a cable having a total of twenty-five, fifty and one hundred twisted wire pairs, it will be appreciated that the invention is not limited by the number of twisted wire pairs forming the cable and that the invention can be practiced with any desired number of twisted wire pairs limited only by spatial constraints and convenience. Similarly, it will be appreciated that the invention is not limited by the number of the twisted wire pairs in each binder unit, and that the invention can be practiced with any desired number of twisted wire pairs in each binder unit. For example, a binder unit may only include two twisted wire pairs, rather than four twisted wire pairs in the illustrated embodiment.

While the invention has been specifically described in connection with certain specific embodiments thereof, it is to be understood that this is by way of illustration and not of limitation, and the scope of the appended claims should be construed as broadly as the prior art will permit.

What is claimed is:

1. A cable, comprising a pre-selected number of binder units, each binder unit comprising a plurality of pairs of conductors surrounding a single pair of conductors encircling a length of filler material, a unit wrap surrounding said plurality of pair of conductors, said single pair of conductors and said filler material, and a shield enclosing said unit wrap; and a jacket placed around said pre-selected number of binder units.

2. The cable of claim 1, wherein said shield comprises a foil free edge tape.

3. The cable of claim 2, wherein said foil free edge tape comprises a first layer of conducive foil and a second layer of non-conductive material such that width of said first layer is smaller than a width of said second layer.

4. The cable of claim 3, wherein said foil free edge tape is applied with said first layer oriented inwardly.

5. The cable of claim 4, wherein each binder unit further includes a unit drain wire is interposed between said unit wrap and said foil free edge tape.

6. The cable of claim 1, wherein said plurality of pairs of conductors comprises six quads.

7. The cable of claim 1, wherein said shield comprises a foil having a non-conductive backing.

8. The cable of claim 7, wherein said shield is arranged with said foil oriented inwardly.

9. A telecommunications cable, comprising:

a preselected number of binder units, each binder unit comprising a predetermined plurality of twisted wire pairs surrounding a single pair of conductors encircling a length of filler material, said plurality of twisted wire pairs enclosed by a unit wrap, said unit wrap further enclosed by a foil free edge tape, wherein said preselected number of binder units are arranged to form a core enclosed by a core wrap and a core shield such that a core drain wire is interposed between said core wrap and said shield, said shield comprising a foil having a conductive and a non-conductive surface.

10. The cable of claim 9, wherein said conductive surface of said shield is inwardly oriented.

11. The cable of claim 9, wherein said foil free edge tape comprises a first layer of conducive foil and a second layer of non-conductive material such that width of said first layer is smaller than a width of said second layer.

12. The cable of claim 11, wherein said foil free edge tape is applied with said first layer oriented inwardly.

13. The cable of claim 9, wherein said plurality of twisted wire pairs comprises twenty-five twisted wire pairs.

14. The cable of claim 9, wherein said core shield comprises a foil having a non-conductive backing.

15. The cable of claim 14, wherein said core shield is arranged with said foil oriented inwardly.

16. A method for manufacturing a cable, comprising the steps of:

pre-selecting a number of twisted paired conductors to bundle as a binder unit, said binder unit including an even number of twisted paired conductors and an additional twisted pair of conductors encircling a filler material to make a total number of twisted paired conductors an odd number;

enclosing said binder unit in a binder core wrap;

enclosing said binder core wrap with a shield to form a shielded binder unit;

pre-selecting a number of said binder units to enclose with an overall core wrap; and wrapping said overall core wrap with an overall shield.

17. The method of claim 16, further comprising the step of surrounding said cable with a jacket material.

18. The method of claim 16, wherein said even number of twisted paired conductors comprises six quads.

19. The method of claim 16, wherein said shield comprises a foil free edge tape having a first layer of conducive foil and a second layer of non-conductive material such that width of said first layer is smaller than a width of said second layer.

20. The method of claim 19, further comprising the step of applying said foil free edge tape to enclose said binder core wrap with said first layer of said foil free edge tape oriented inwardly.

* * * * *